US007722151B2

(12) United States Patent
Elenes et al.

(10) Patent No.: US 7,722,151 B2
(45) Date of Patent: May 25, 2010

(54) PRINTING APPARATUS

(75) Inventors: Luis Elenes, Vancouver, WA (US); Wesley R. Schalk, Vancouver, WA (US); Scott Martin, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 677 days.

(21) Appl. No.: 11/700,694

(22) Filed: Jan. 30, 2007

(65) Prior Publication Data

US 2008/0180481 A1 Jul. 31, 2008

(51) Int. Cl.
*B41J 2/165* (2006.01)
*B41J 2/01* (2006.01)

(52) U.S. Cl. ..... 347/22; 347/104

(58) Field of Classification Search ..... 347/22, 347/29, 30, 32, 33, 35, 104
See application file for complete search history.

(56) References Cited

U.S. PATENT DOCUMENTS

| | | | | |
|---|---|---|---|---|
| 5,831,644 | A * | 11/1998 | Kato | 347/22 |
| 5,971,520 | A * | 10/1999 | Nakahara | 347/30 |
| 6,328,412 | B1 | 12/2001 | Taylor et al. | |
| 6,533,387 | B2 * | 3/2003 | Simmons et al. | 347/32 |
| 6,578,945 | B2 * | 6/2003 | Hashi et al. | 347/22 |
| 2006/0139398 | A1 | 6/2006 | Chiu et al. | |

* cited by examiner

*Primary Examiner*—Shih-Wen Hsieh

(57) ABSTRACT

A printing apparatus is disclosed.

19 Claims, 9 Drawing Sheets

PRINTING APPARATUS

BACKGROUND

Inkjet printers operate using a print head including a plurality of nozzles, which spray ink directly onto a print medium. Print head nozzles often become clogged with ink or particulates resulting in inefficient operation of the print heads and reduced print quality. Therefore, inkjet printers usually include a service station that provides functions for maintenance of the print heads. In order to provide this printer functionality, conventional printers employ multiple drive motors. This adds considerable expense and complexity to the printing device. Accordingly, the ever-increasing demand for printing devices, such as inkjet printers, to provide high quality printing while minimizing manufacturing costs motivates the need to look for an alternative solution to accomplish this printer functionality.

BRIEF DESCRIPTION OF THE DRAWINGS

FIG. 2(*a*) shows a view of a service station subsystem in accordance with an embodiment.

FIG. 2(*b*) shows an alternate view of the service station subsystem whereby additional elements are illustrated.

FIG. 3(*a*) shows a view of the service station subsystem in conjunction with the carriage lift operational state.

FIG. 5(*a*) shows a view of the service station subsystem in conjunction with the primer drive "priming" operational state.

DETAILED DESCRIPTION

Figure 1:
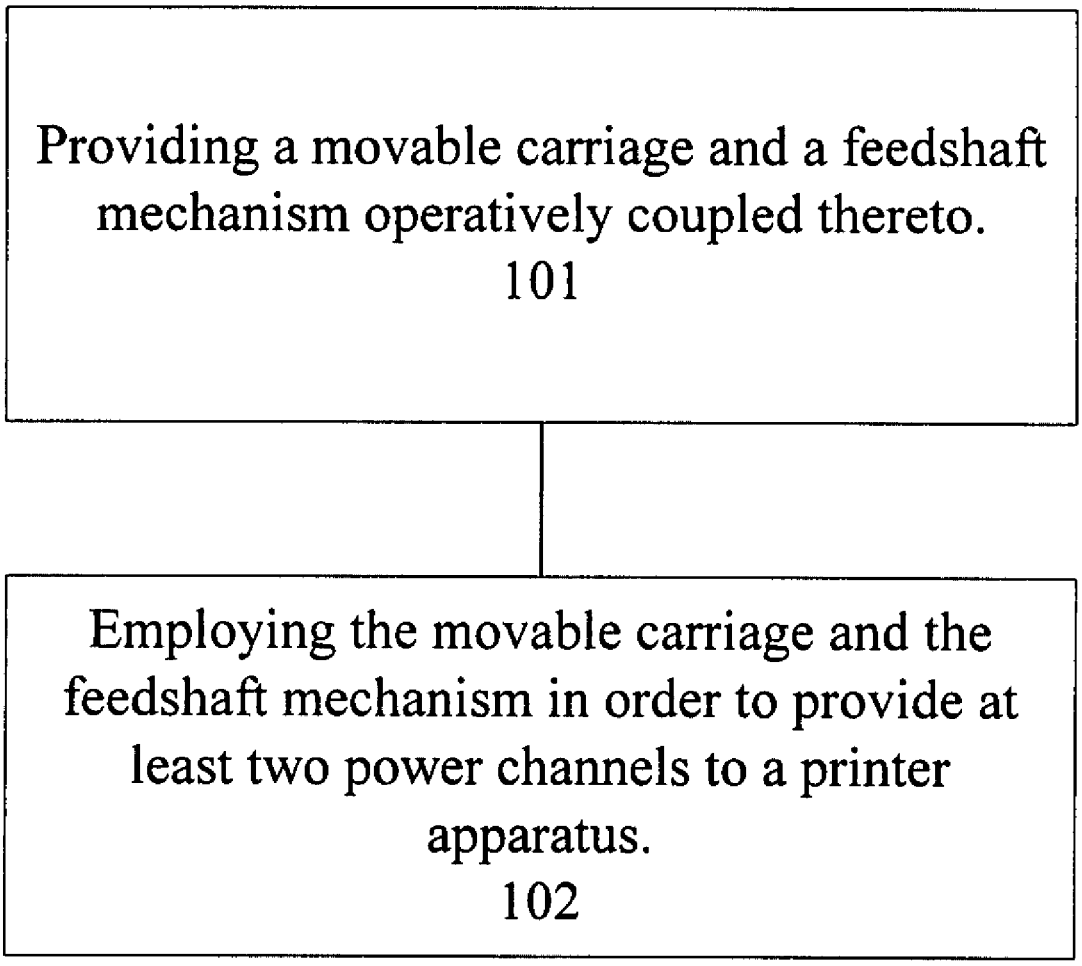
FIG. 1 is a high-level flowchart of a method in accordance with an embodiment.

As shown in the drawings for purposes of illustration, a printing apparatus and a method of use thereof is disclosed. In an embodiment, the printing apparatus includes a media delivery motor, a pallet, a carriage and a transmission operatively coupled to the media delivery motor, the transmission configured to power a servicing operation and lift a carriage whereby multiple power channels can be selected based on media delivery motor motion, carriage movement, and pallet position. Accordingly, the transmission takes rotational motion from a paper path motor and enables three independent power channels in a service station side of the printing apparatus.

For the purposes of this patent application, a power channel is a source of mechanical rotational motion, available indefinitely, in both clock-wise and counter clock-wise rotational directions. A power channel can be used (and or temporarily coupled) to drive a mechanical system (or transmission) that employs rotational motion, to provide an assortment of functions. In an embodiment, three power channels are employed to service pens, the lift carriage and drive a pen primer without the addition of a dedicated DC motor to the service station. The individual power channels are selected by a combination of feed shaft, carriage and pallet motions. Once engaged each power channel is independent of the other and both rotational directions are available for each power channel.

FIG. 1 is a high-level flowchart of a method in accordance with an embodiment. A first step 101 involves providing a movable carriage and a feed shaft mechanism operatively coupled thereto. A next step 102 involves employing the movable carriage and the feed shaft mechanism in order to provide at least two power channels to a printer apparatus. In an alternate embodiment, three independent power channels are provided.

Figure 2:
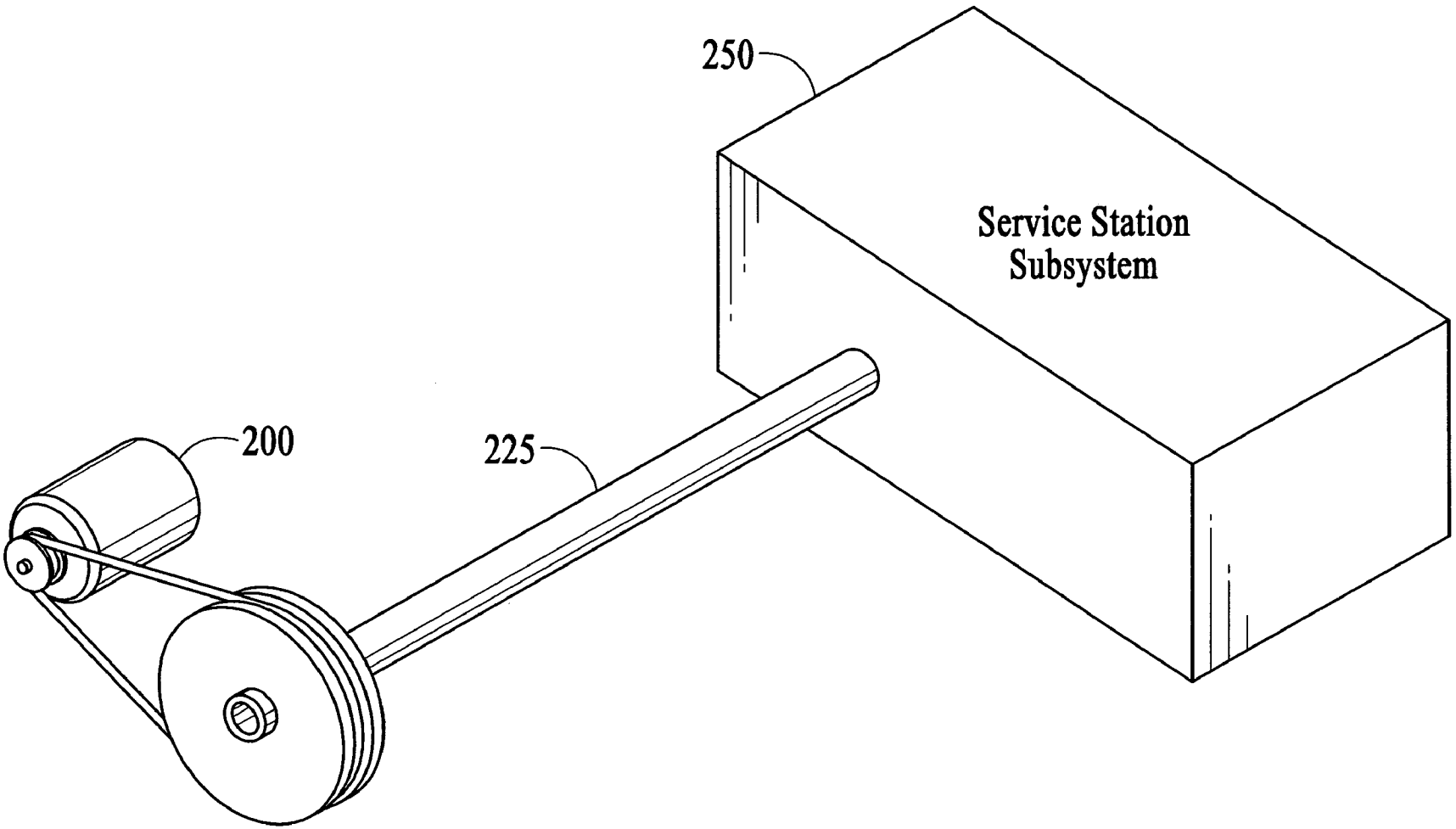
FIG. 2 illustrates a drive transmission configuration in accordance with an embodiment.
Figure 2A:
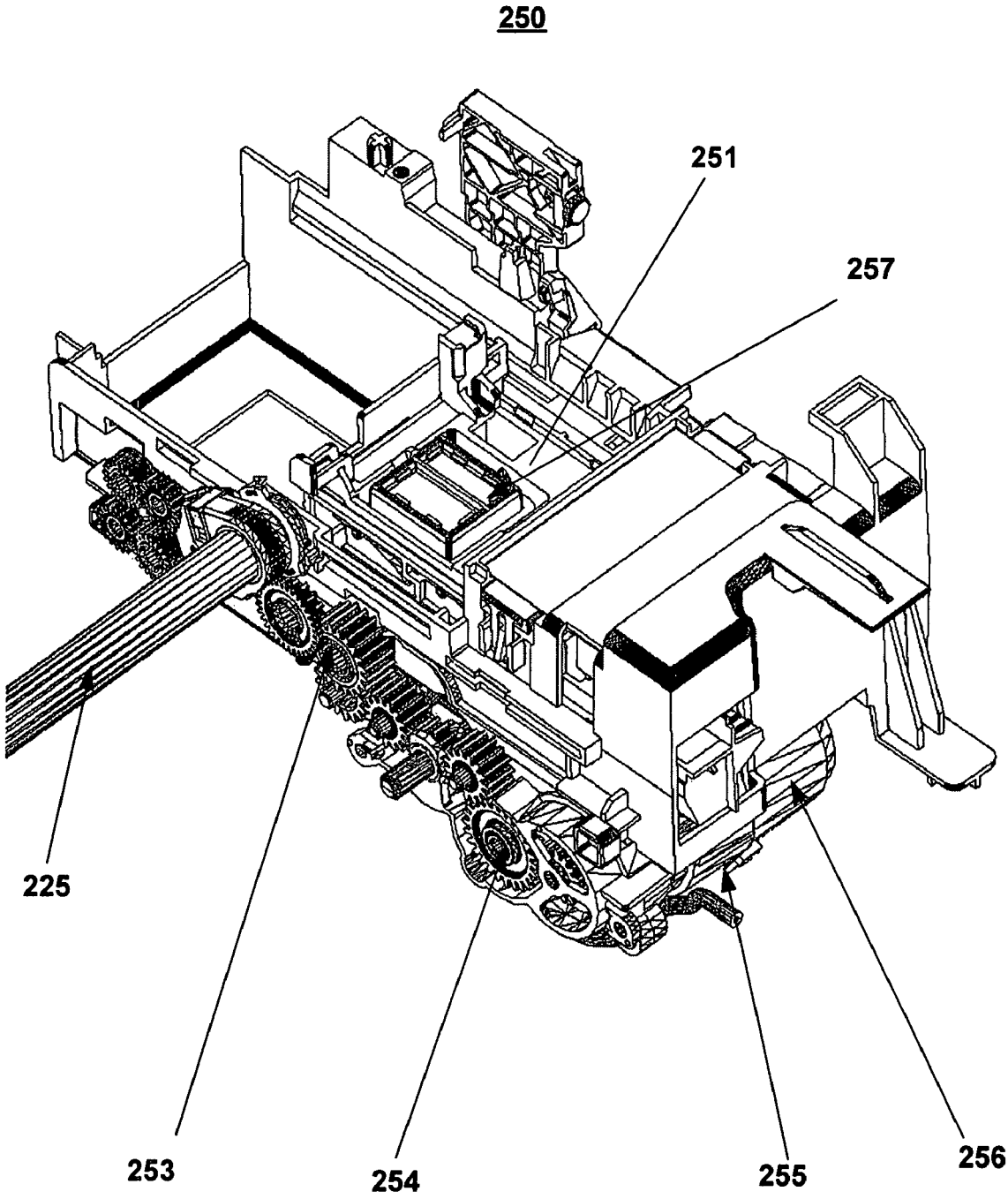

FIG. 2 illustrates a drive transmission configuration in accordance with an embodiment. FIG. 2 includes a media delivery motor 200, a feed shaft mechanism 225 and a service station subsystem 250. As can be seen in FIG. 2, the media delivery motor 200 is coupled to the service station subsystem 250 via the feed shaft mechanism 225.

In an embodiment, the service station subsystem 250 includes a service station drive transmission and a primer transmission. For a better understanding, please refer now to FIG. 2(*a*). FIG. 2(*a*) shows a view of a service station subsystem 250 in accordance with an embodiment. Accordingly, the service station subsystem 250 includes a service station transmission 253, a primer drive transmission 254, a black channel 255, a color channel 256, a cap 257 and pallet 251.

FIG. 2(*b*) shows an alternate view of the service station subsystem 250 whereby additional elements are illustrated. FIG. 2(*b*) includes a shift arm 226, a cam lift gear 228, a spittoon 258, a swing arm assembly 259, a drive shaft 234 and a carriage lift arm 260.

Accordingly, with a synchronized combination of movements between the media delivery motor 200, the feed shaft mechanism 225 and the service station subsystem 250, three states of operation are capable of being enabled: a carriage lift state, a service station drive state and a primer drive state.

Carriage Lift State

In order to enable this state of operation, the media delivery motor engages a forward feed and then the carriage moves to the home shift position. Home shift position is when the carriage reaches the far right side of the printer (as observed from the user's perspective). In this position, the swing arm assembly 259 has engaged either the carriage lift or pallet drive transmission, depending if the feed shaft direction was either forward or reverse prior to reaching the carriage stop location at home shift position. Forward feed is the direction of the feed shaft such that a piece of paper in the print mechanism would be ejected towards the user. Reverse feed is the opposite direction relative to forward feed. Here media would be reversed into the print mechanism and moved away from the user. Additionally, at home shift position, the carriage can also move off (in left direction) and continue printing or doing other functions.

Figure 3:
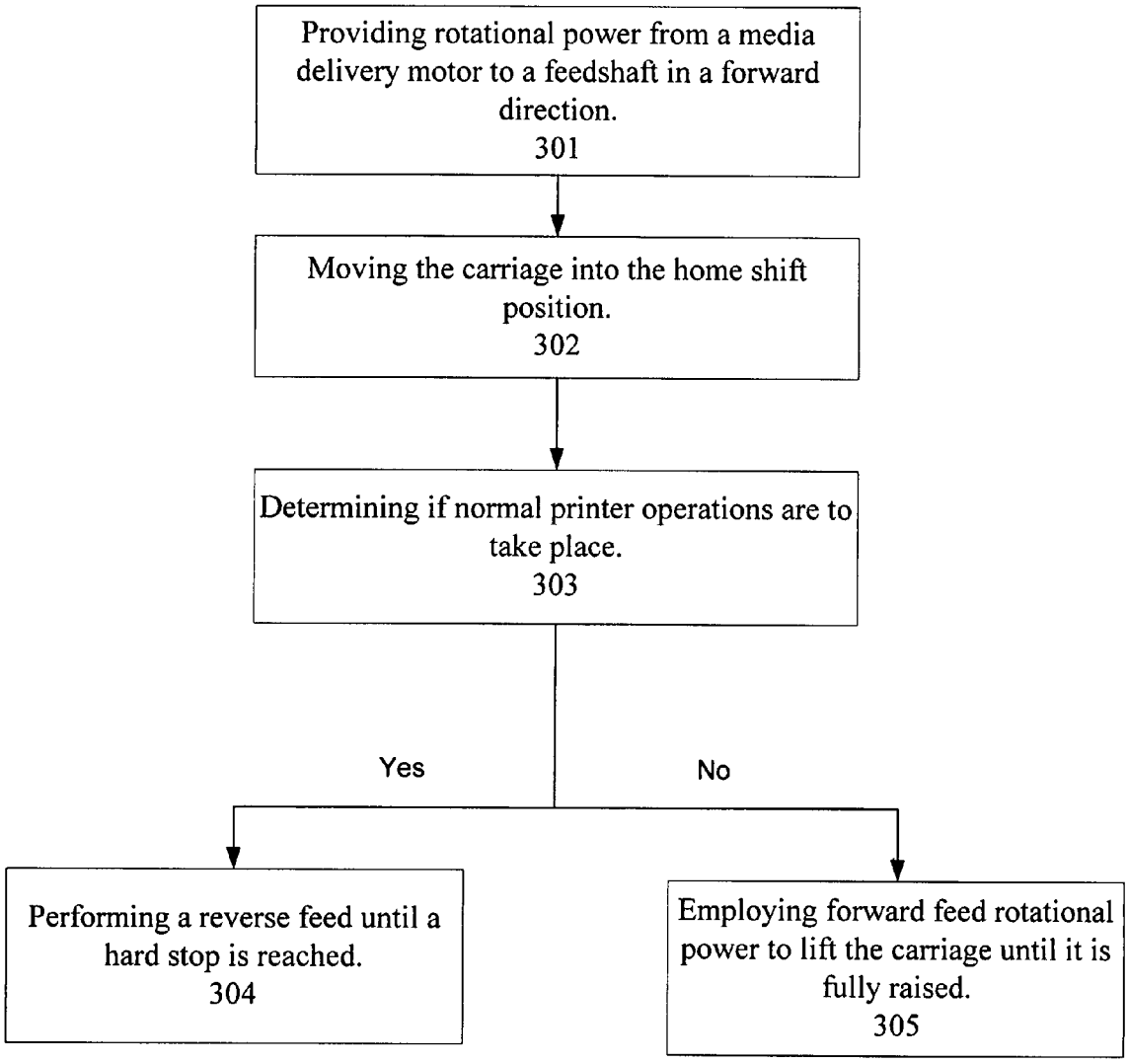
FIG. 3 illustrates a flowchart of the carriage lift operational state in accordance with an embodiment.
Figure 3A:
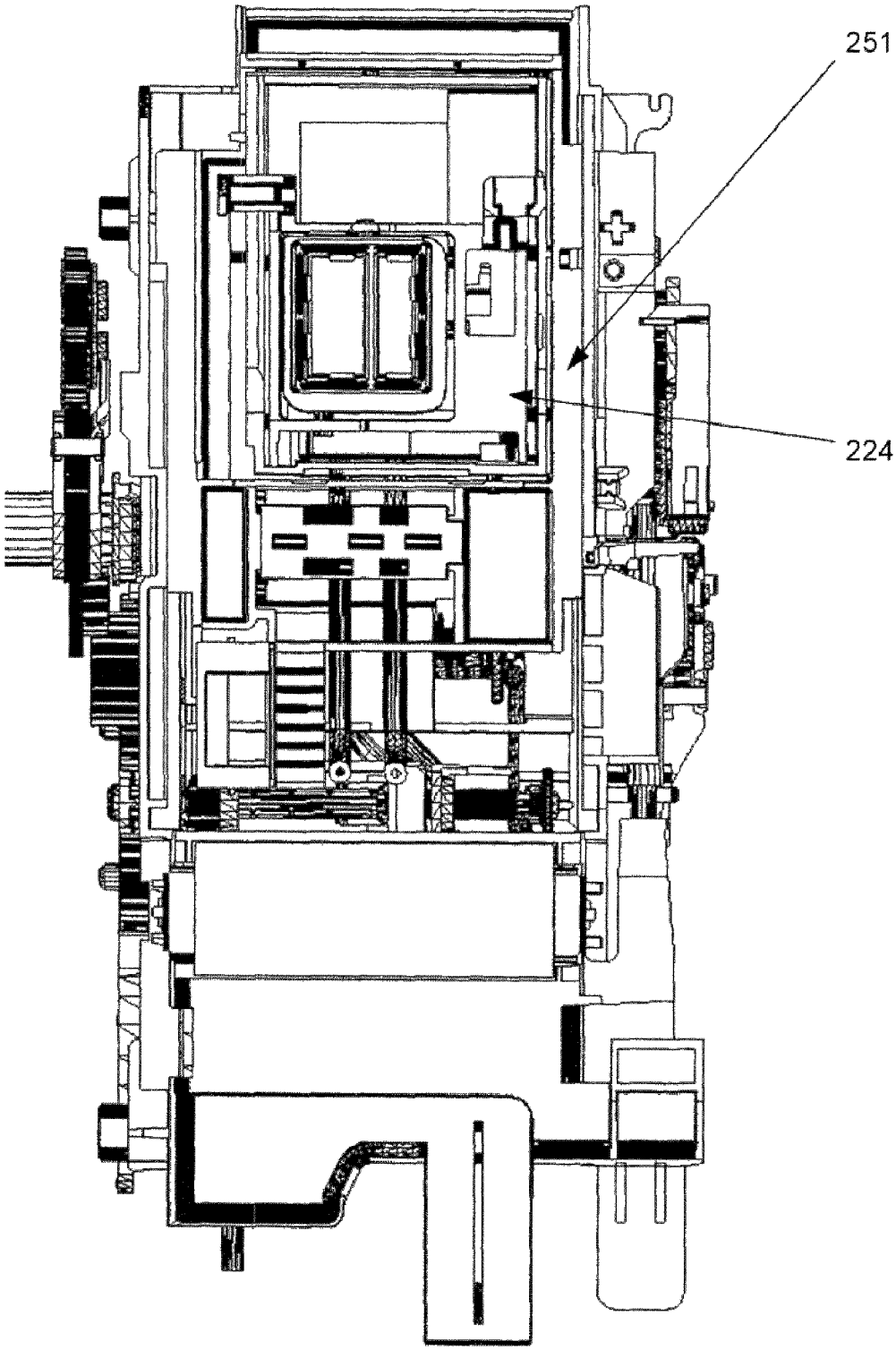

FIG. 3 illustrates a flowchart of the carriage lift operational state. A first step 301 providing rotational power from a media delivery motor to a feed shaft in a forward direction. A second step 302 includes moving the carriage into the home shift position. A third step 303 involves determining if normal printer operations are to take place. If yes, step 304 involves performing a reverse feed until a hard stop is reached. A "Hard stop" refers to a designed position where mechanical parts interfere causing the DC servo to stop sending voltage to the driving motor. "Hard stops" are commonly used to safely go to known and repeatable mechanical positions in an electro mechanical device such as a printer. If no, step 305 involves employing forward feed rotational power to lift the carriage until it is fully raised.

Figure 2B:
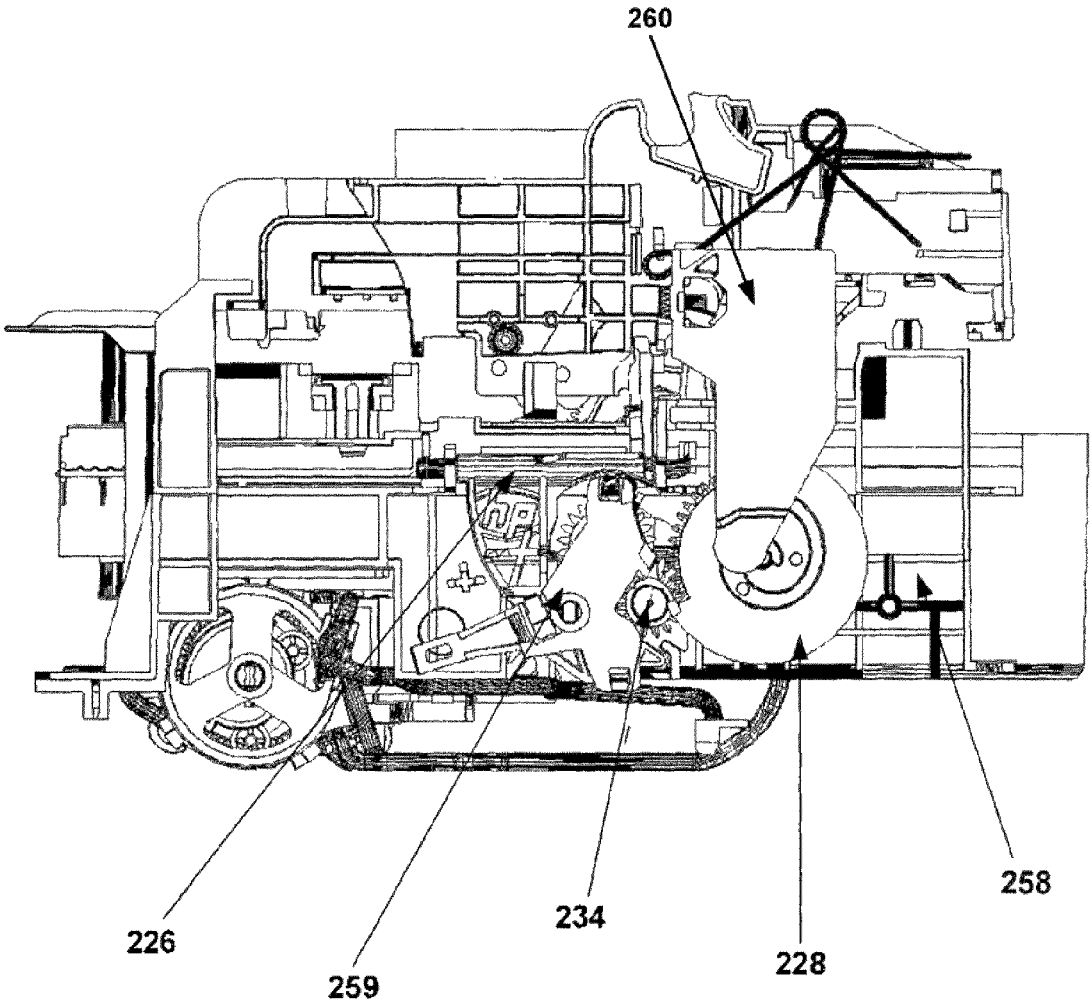

FIG. 3(*a*) shows a view of the service station subsystem 250 in conjunction with the carriage lift operational state. FIG. 3(*a*) illustrates the carriage 224 (not shown) and the pallet 251 whereby the carriage 224 and the pallet 251 are in the home shift position. In the carriage lift state of operation, normal printing and servicing operations can be performed as well as printing on a CD or other rigid media In order to print on a CD or other rigid media, forward feed rotational power is employed to lift the carriage until it is fully raised. A forward feed of feed shaft 225 aligns the swing arm assembly 259 to be ready to engage the cam lift gear 228. With a carriage home shift position move, the carriage 224 applies a load to the shift arm 226 which in turn pivots about its axis. Since the shift arm 226 is coupled to the swing arm assembly 259, this rotation about the shift arm axis causes the translation of the shift arm assembly 259 to the left direction. With this translation, a driving gear (not shown) mates with the cam lift gear 228 and rotates it in the clockwise direction (as seen from FIG. 2*b*). Rotation of the cam lift gear 228 produces translation of the carriage lift arm 260 thus raising the carriage 224 upwards.

In order to perform normal printing and servicing operations, a forward feed and carriage home shift is performed, after which a reverse feed is performed until a hard stop is reached thereby returning the carnage to a lower (default) state. Normal printing operations refers to all actions performed in the print mechanism, which do not include carriage lift, pen servicing need or functions, or priming. Normal printing operations include picking of media, feeding of media in mechanism, firing ink onto page, etc.

Service Station Drive State

In order to enable this state of operation, the media delivery motor engages a reverse feed and the carriage is in the home shift position. In this operational state, wiping, spitting, wiper scraping, capping and all other general service takes place. For spitting, the carriage leaves the home shift position once the pallet is moved forward and interlocked. To uncap and return to printing, a reverse feed shaft move is made until the drive transmission releases from its interlocked state. This release occurs once the pallet is at the full back position and the pallet remains in this position until service moves or capping is needed.

Figure 4:
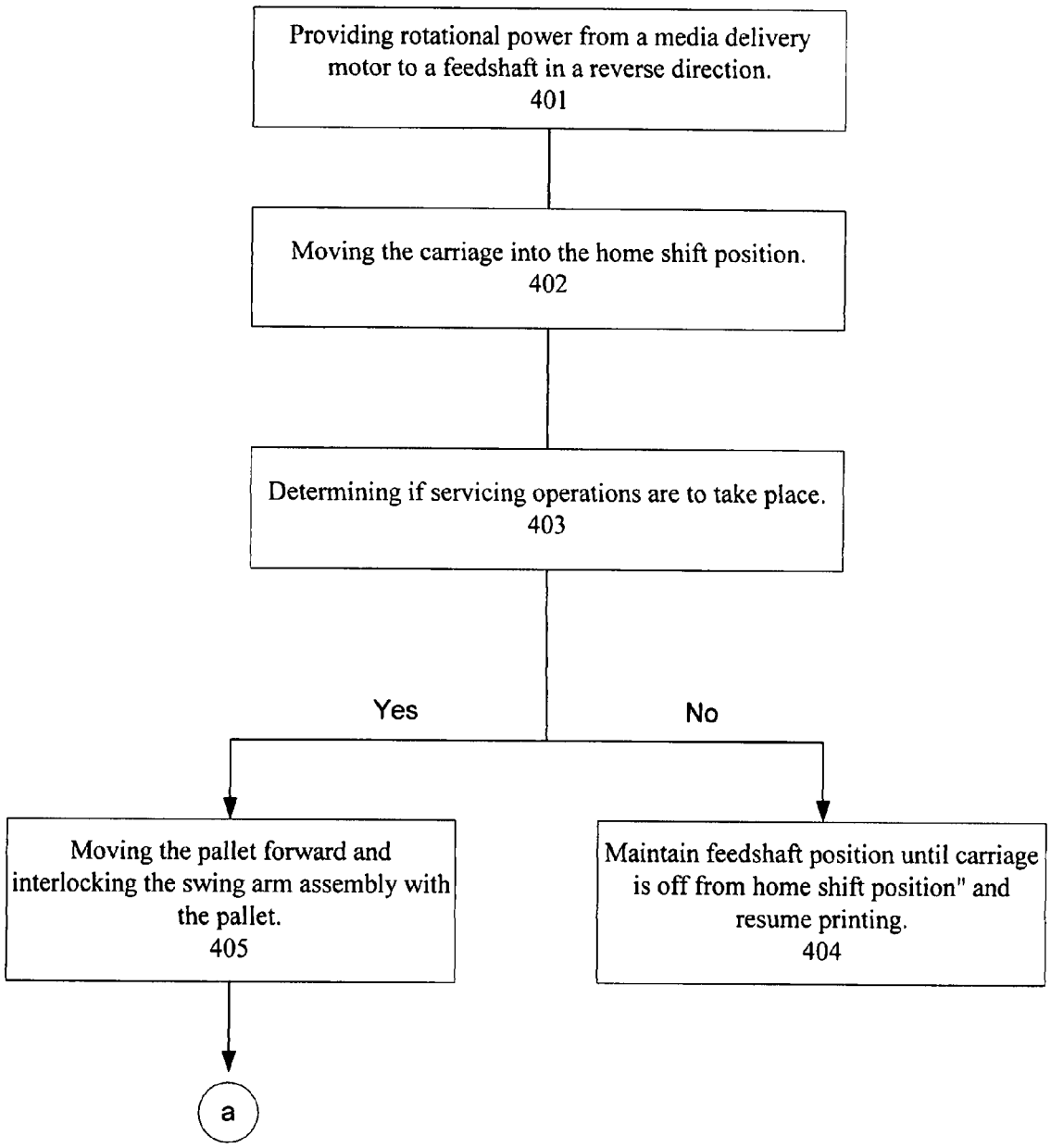
FIG. 4 illustrates a flowchart of the service station drive operational state in accordance with an embodiment.

FIG. 4 illustrates a flowchart of the service station drive operational state. A first step 401 providing rotational power from a media delivery motor to the feed shaft in a reverse direction. A second step 402 includes moving the carriage into the home shift position. A third step 403 includes determining if servicing operations are to take place. If no, step 404 involves maintaining the feed shaft position until the carriage is off from the home shift position and resuming printing. If yes, step 405 involves moving the pallet forward and interlocking the swing arm assembly with the pallet via the pallet interlocking rib.

In this embodiment, a reverse feed of feed shaft 225 aligns the swing arm assembly 259 to be read to engage the service station drive shaft 234. With a carriage home shirt position move the carriage 224 applies a load to the shift arm 226 which in turn pivots about its axis. Since the shift arm 226 is coupled to the swing arm assembly 259, this rotation about the shift arm axis causes the translation of the shift swing arm assembly 259 to the left direction. With this translation the driving gear (not shown) mates with the service station drive shaft 234 and rotates it in the counter-clockwise direction (as seen from FIG. 2*b*). The service station drive shaft 234 mates with a rack (not shown) on the underside of the pallet 251 thus driving it forward with a counter-clockwise rotation. Once the driving gear (not shown) begins to drive the pallet 251, it remains interlocked, and can drive the pallet 251 back and forth for general pen servicing or enter the primer drive state.

Primer Drive State

This operational state allows pen priming and tube purging operations to take place. As previously articulated, pen priming involves the removal of air that has migrated into the printing nozzles and purging involves removing stagnant waste ink that has accumulated inside the tubes. Engaging this state employs the same reverse feed shaft move and carriage home shift as employed by the service station drive state. The difference is that in the pallet "capped" position and pallet "purge" position, a carriage "left shift" is employed. Pallet capped position is defined as the position in which the forward position of the pallet has caused the rubber cap to translate up and create a seal around the orifice plate of the pen (not shown). Here, the pallet is in a position further forward relative to a user. Pallet purge position is similar to the pallet capped position, however in the purge position the seal between the cap and the orifice of the pen is broken thereby allowing air to escape.

A carriage "left shift" is accomplished when the carriage 224 engages a horn feature on cap 257 in the "capped" or "purge" positions. Once this feature on the cap 257 is engaged, the carriage 224 physically moves left approx 8 mm, pulling the cap 257 with it. A carriage "left shift" disengages the driving of the pallet 251 and engages the driving of the primer. When the left shift occurs, rotational power is routed from the service station drive transmission to the primer drive transmission. In this operational state, reverse feed shaft rotational power allows for priming/purging of the color channel while forward feed shaft rotational power allows for priming/purging of the black channel.

Figure 5:
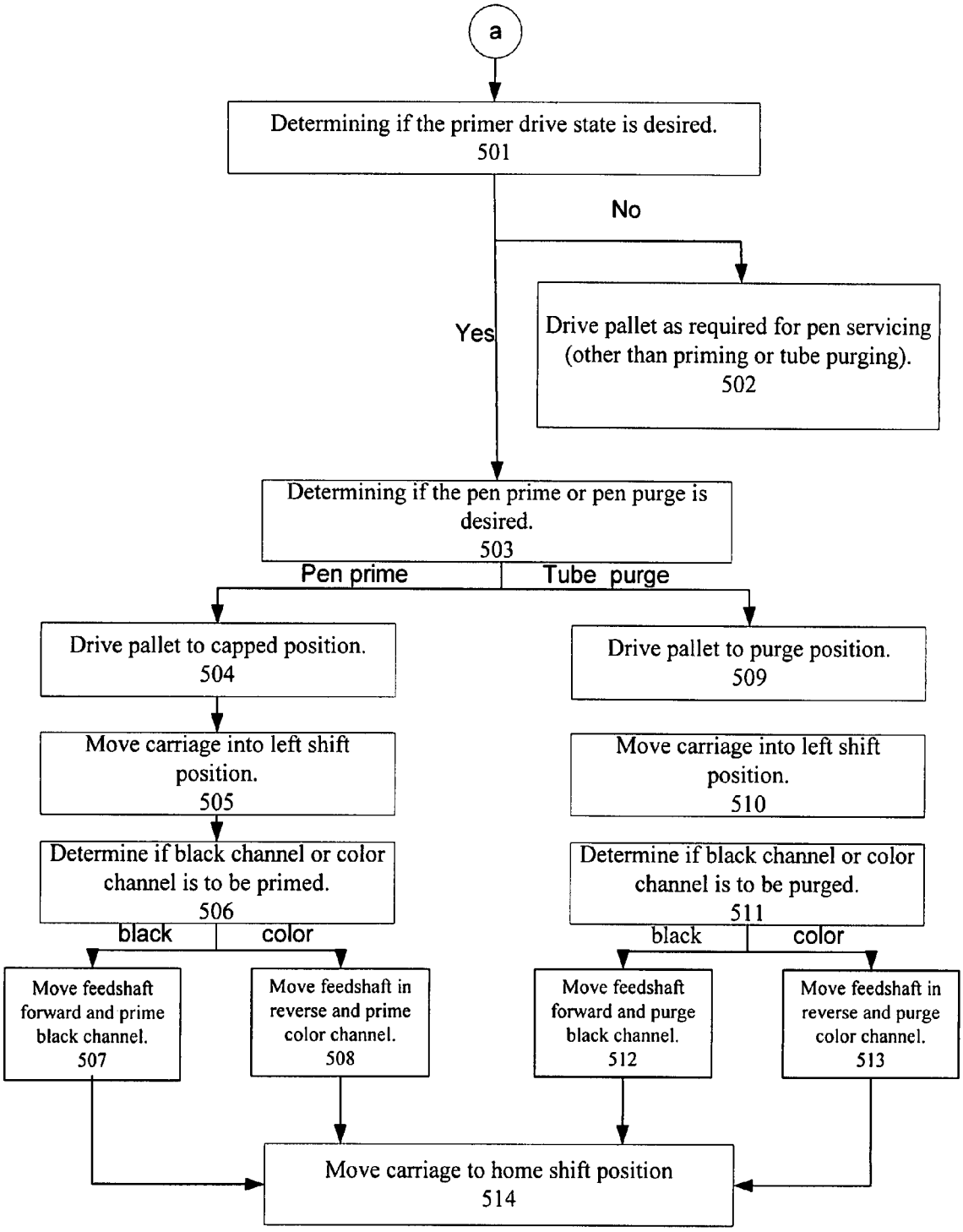
FIG. 5 illustrates a flowchart of the service station drive operational state in accordance with an embodiment.
Figure 5A:
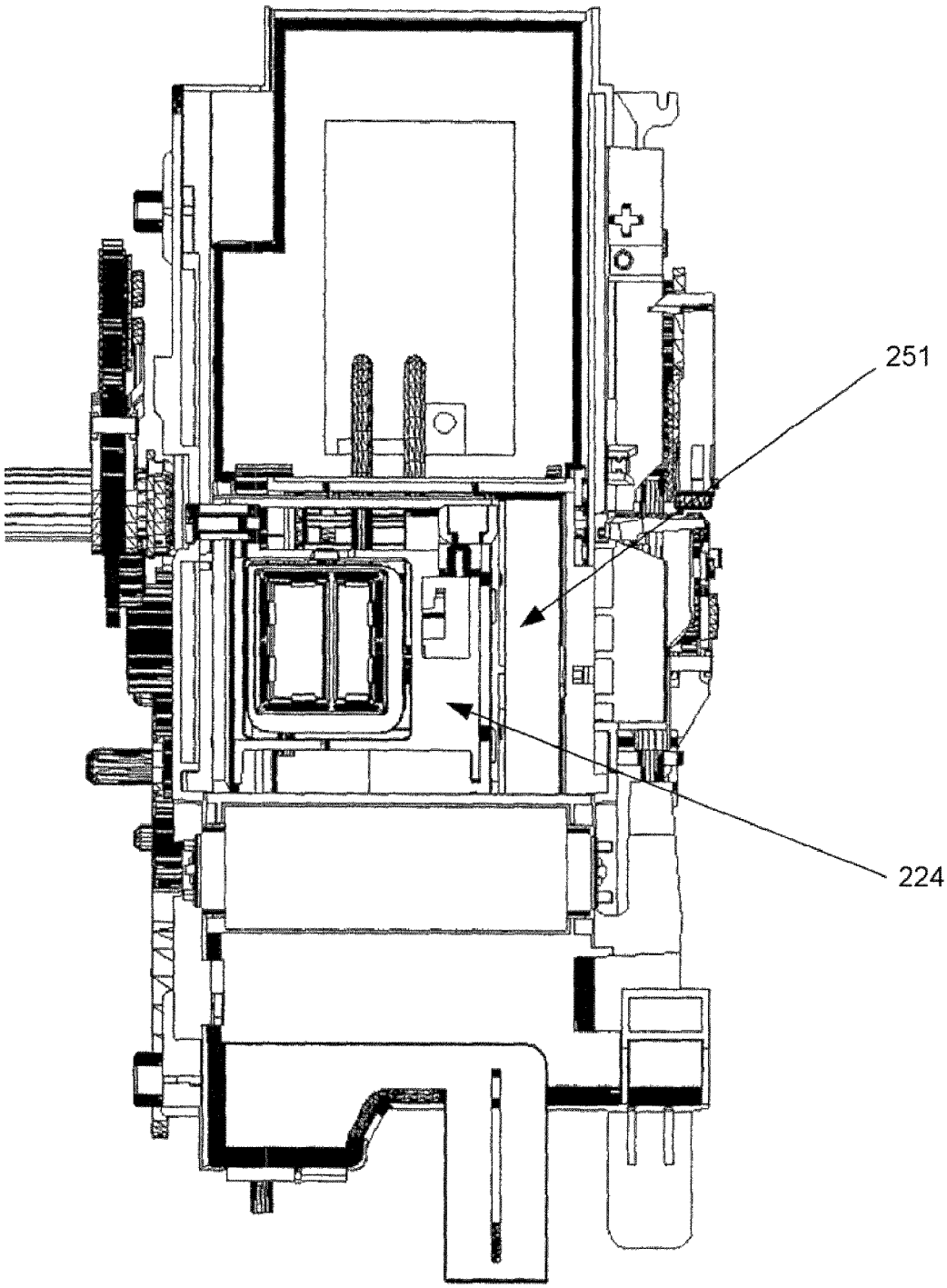

FIG. 5 illustrates a flowchart of the primer drive operational state. A first step 501 determining if primer operations are to lake place. If no, step 502 involves driving the pallet as needed for pen servicing. Here, pen servicing involves all servicing other than pen priming or tube purging. If yes, step 503 involves determining if a pen prime or pen purge is desired.

If a pen prime is desired, steps 504-508 are performed. Step 504 involves driving the pallet to a capped position. Step 505 includes moving the carriage into the left shift position. Here, the primer drive transmission is engaged and the pallet drive transmission is disengaged. FIG. 5(*a*) shows a view of the service station subsystem 250 in conjunction with the primer drive operational state. FIG. 5(*a*) shows the pallet 251 in the "capped" position and the carriage 224 in the left shift position. A next step 506 includes determining if the black channel or the color channel is to be primed. If the black channel is to be primed, step 507 involves moving the feed shaft forward and priming the black channel. If the color channel is to be primed, step 508 involves moving the feed shaft in a reverse direction and priming the color channel.

Going back to step 503, if a pen purge is desired, steps 509-513 are performed. Step 509 involves driving the pallet to a purge position. Step 510 includes moving the carriage into the left shift position. Again, here the primer drive transmission is engaged and the pallet drive transmission is disengaged. A next step 511 includes determining if the black channel or the color channel is to be purged. If the black channel is to be purged, step 512 involves moving the feed shaft in a reverse direction and purging the black channel. If the color channel is to be purged, step 513 involves moving the feed shaft forward and purging the color channel.

Once the purge or prime is completed, in order to get out of this state of operation and back to the service station drive state, a carriage right shift is performed via step 514 whereby the primer drive transmission is disengaged and the pallet drive transmission is engaged. Consequently, the pallet is free to move for more servicing operations or printing operations.

A printing apparatus and a method of use thereof is disclosed. In an embodiment, the printing apparatus includes a media delivery motor and a transmission operatively coupled to the media delivery motor to provide rotational power from the motor to a service station subsystem. Accordingly, the transmission takes rotational motion from a paper path motor and enables three independent power channels in a service station side of the printing apparatus.

Without further analysis, the foregoing so fully reveals the gist of the present inventive concepts that others can, by applying current knowledge, readily adapt it for various applications without omitting features that, from the standpoint of prior art, fairly constitute the characteristics of the generic or specific aspects of this invention. Therefore, such applications should and are intended to be comprehended within the meaning and range of equivalents of the following claims. Although this invention has been described in terms of certain embodiments, other embodiments that are apparent to those of ordinary skill in the art are also within the scope of this invention, as defined in the claims that follow.

The invention claimed is:

1. A printing apparatus, comprising:

a media delivery motor;

a movable pallet operable to perform a servicing operation;

a carriage movable independently of the pallet; and a transmission coupled to the media delivery motor and configured to engage the media delivery motor to selectively power the servicing operation and a lift of the carriage operation through multiple independent power channels based on different respective combinations of rotational motion driven by the media delivery motor, movement of the carriage, and position of the pallet.

2. The apparatus of claim 1 wherein the transmission provides power to a servicing unit.

3. The apparatus of claim 1 wherein the transmission provides power to a primer unit.

4. The apparatus of claim 1 wherein the transmission provides rotational power to a service station subsystem based on the multiple independent power channels.

5. The apparatus of claim 4 wherein the multiple independent power channels comprises three independent power channels.

6. The apparatus of claim 5 wherein each of the three independent power channels is associated with one of three states of operation, wherein the three states of operation comprises a carriage lift state, a service station drive state and a primer drive state.

7. The apparatus of claim 6 wherein the carriage lift state includes utilizing the transmission to operate a feed shaft in a forward direction.

8. The apparatus of claim 6 wherein the service station drive state and the primer drive state includes utilizing the drive transmission to operate a feed shaft in a reverse direction.

9. A method of operating a printer apparatus comprising:

providing a movable carriage and a feed shaft mechanism; and employing the movable carriage and the feed shaft mechanism in order to provide at least two independent power channels each driving a respective printer apparatus operation selected from a lift the carriage operation, a servicing operation, and a primer driver operation, wherein provision of each of the power channels depends on a different respective synchronized combination of position of the carriage and rotational motion of the feed shaft mechanism.

10. The method of claim 9 wherein the at least two independent power channels comprises three independent power channels each driving a respective printer apparatus operation selected from the lift the carriage operation, the servicing operation, and the primer driver operation.

11. The method of claim 9 wherein each of the at least two independent power channels are associated with one of a plurality of operative states.

12. A method of operating a printer apparatus comprising:

providing a movable carriage and a feed shaft mechanism; and employing the movable carriage and the feed shaft mechanism in order to provide at least two independent power channels to the printer apparatus, wherein each of the at least two independent power channels is associated with one of a plurality of operative states, and the plurality of operative states further comprise a carriage lift state, a service station drive state, and a primer drive state.

13. The method of claim 12 wherein the carriage lift state comprises:

utilizing the feed shaft mechanism to provide rotational power in a forward direction.

14. The method of claim 12 wherein the service station drive state and the primer drive state comprises:

utilizing the feed shaft mechanism to provide rotational power in a reverse direction.

15. The method of claim 13 wherein the carriage lift state enables normal printing operations with the printer apparatus.

16. The method of claim 14 wherein the service station drive state enables pen servicing operations with the printer apparatus.

17. A printing apparatus, comprising:

a media delivery motor;

a carriage;

a feed shaft mechanism operatively coupled to the media delivery motor; and a service station subsystem operatively coupled to the feed shaft mechanism, wherein the service station subsystem comprises a carriage lift mechanism that is operable to engage the carriage and at least one transmission that is operable to selectively engage the feed shaft mechanism to provide rotational power to the carriage lift mechanism and lift the carriage.

18. The printing apparatus of claim 17 wherein the service station subsystem further comprises:

a pallet.

19. The printing apparatus 17 wherein the at least one transmission comprises a service station transmission and a primer drive transmission.

* * * * *